US007733222B2

(12) United States Patent
Karim et al.

(10) Patent No.: US 7,733,222 B2
(45) Date of Patent: Jun. 8, 2010

(54) REMOTELY CONTROLLABLE ROUTE INDICATING DEVICES

(75) Inventors: Zia Karim, Saint Charles, IL (US); Daniel C. Hawkinson, Elburn, IL (US); Andrew G. Berezowski, Wallingford, CT (US)

(73) Assignee: Honeywell International Inc., Norristown, PA (US)

( * ) Notice: Subject to any disclaimer, the term of this patent is extended or adjusted under 35 U.S.C. 154(b) by 321 days.

(21) Appl. No.: 12/051,439

(22) Filed: Mar. 19, 2008

(65) Prior Publication Data

US 2009/0237242 A1 Sep. 24, 2009

(51) Int. Cl.
*G08B 1/08* (2006.01)

(52) U.S. Cl. ..... 340/539.22; 340/628; 340/692; 340/691.1; 340/691.8; 340/506; 340/384.1

(58) Field of Classification Search ..... 340/539.22, 340/539.26, 540, 601, 628, 629, 630, 633, 340/634, 692, 691.1, 691.8, 691.2, 691.3, 340/517, 521, 522, 506, 332, 328, 384.1
See application file for complete search history.

(56) References Cited

U.S. PATENT DOCUMENTS

| | | | | |
|---|---|---|---|---|
| 4,816,809 | A * | 3/1989 | Kim | 340/692 |
| 5,165,465 | A * | 11/1992 | Kenet | 165/11.1 |
| 5,309,146 | A * | 5/1994 | Kenet | 340/540 |
| 5,576,685 | A * | 11/1996 | Saito | 340/384.1 |
| 5,663,714 | A * | 9/1997 | Fray | 340/692 |
| 5,724,020 | A | 3/1998 | Hsu | |
| 6,201,470 | B1 | 3/2001 | Withington | |
| 6,317,042 | B1 | 11/2001 | Engelhorn et al. | |
| 6,518,878 | B1 | 2/2003 | Skoff | |
| 6,538,568 | B2 | 3/2003 | Conley | |
| 6,778,071 | B2 | 8/2004 | Megerle | |
| 6,873,256 | B2 | 3/2005 | Lemelson et al. | |
| 7,026,947 | B2 | 4/2006 | Faltesek et al. | |
| 7,142,093 | B2 | 11/2006 | Foster et al. | |
| 2006/0071802 | A1 | 4/2006 | Right et al. | |
| 2006/0226977 | A1 | 10/2006 | DeLozier et al. | |
| 2007/0046462 | A1 | 3/2007 | Fancella | |

FOREIGN PATENT DOCUMENTS

| | | |
|---|---|---|
| FR | 2686177 A1 | 1/1992 |
| FR | 2686177 B1 | 1/1992 |

OTHER PUBLICATIONS

ExitPoint Directional Sounder, System Sensor, Dec. 2005.
ExitPoint Directional Sounder Presentation, System Sensor, Dec. 2005.
ExitPoint Directional Sounder Applications Guide, System Sensor, Nov. 2004.

* cited by examiner

*Primary Examiner*—Toan N Pham
(74) *Attorney, Agent, or Firm*—Husch Blackwell Sanders Welsh & Katz

(57) ABSTRACT

A flexible audio output device includes control circuits couplable to a communications system and an audio announcement system. The communications system can transmit function specifying parameters to the device. Various forms of directional audio, or verbal messages can be emitted in accordance with received parameters.

20 Claims, 2 Drawing Sheets

REMOTELY CONTROLLABLE ROUTE INDICATING DEVICES

FIELD

The invention pertains to evacuation or exit route indicating devices. More particularly, the invention pertains to such devices which would be activated in the event of a sensed emergency condition, such as a fire, where parametric information for the devices could be provided, and, or altered on a device by device basis during an evacuation.

BACKGROUND

Evacuation is an important aspect of an emergency situation such as fire, gas leak, chemical spill, etc. Locating devices aid in this process by emitting sound patterns that enable occupants of a premise to locate the origin of the sound. Because said sounders are installed near points of egress, an occupant can find the exits more easily. One such system has been disclosed and claimed in U.S. patent application Ser. No. 11/447,376 filed Jun. 6, 2006 entitled "Methods and Systems for Controlling Directional Sounders for Route Guidance". The '376 application has been assigned to the assignee hereof and is incorporated herein by reference.

If during an evacuation, the path to the point of egress becomes hazardous, it would be best if the output of the locating devices marking the point of egress could be altered. Because there may be multiple locating devices marking a long path of egress, it would be advantageous to be able to set parameters of each one individually in a system with many installed. Egress paths can be then adaptively created based on the locating device configurations.

There thus continues to be need for more flexible audible output devices, and systems of same than have previously been available.

DETAILED DESCRIPTION

Figure 1:
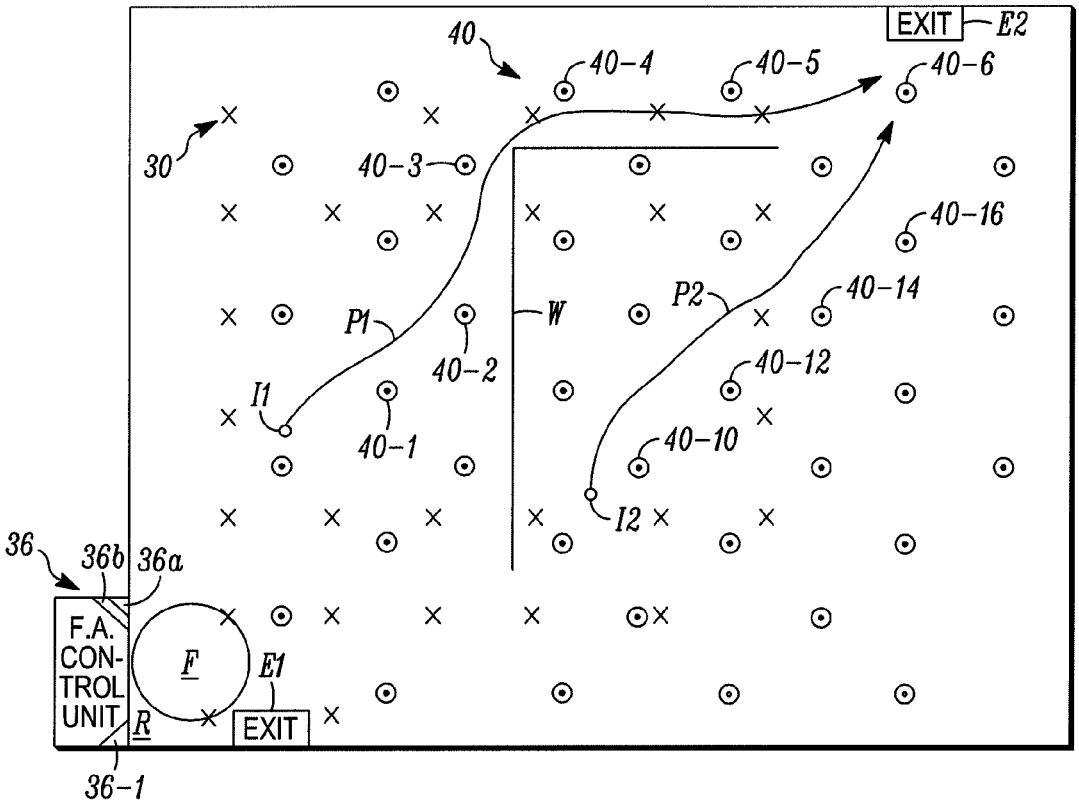
FIG. 1 is a top plan view of a region R where a system which embodies the invention has been installed.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

Embodiments of the invention combine an interface to a communications channel with a directional audio emitting output or evacuation route specifying output device. Command and control information can be transmitted to the output device. Provisioning of the unit would then be automatically performed based on received information. The unit would then be able to be proactively provisioned during an evacuation condition in order to help occupants find the safest egress path possible. Provisionable features could include turning the unit on and off, changing the sound pattern, changing a voice message and bypassing the unit completely so that the voice evacuation system could use the sounder's transducer (or speaker) as an output.

In accordance with the invention, a communications interface can include a transceiver and a protocol controller. Electrical isolation can be provided, if needed, between the communications interface and route indicating sound generator. A voice evacuation system interface includes an electrical isolator and multiplexer to connect the input of an amplifier to the voice evacuation system signal.

In another aspect, control circuits can control the sound generation and provisioning. A digital-to-analog converter recreates the desired analog signal from digital samples generated by the control circuits. An amplifier can be provided to drive a transducer or speaker.

The protocol controller can provide command and control signals to the sound generating control circuits. The sound generating control circuits determine the appropriate action to take based on the commands received.

FIG. 1 is a top plan view of a region R where a system 10 which embodies the invention has been installed. The region R includes two Exits E1, E2, which are spaced apart from one another as well as a plurality of ambient condition detectors 30.

The members of the plurality, such as 30*i* can be installed throughout the region R in an arbitrary fashion. Representative types of detectors include smoke detectors, gas detectors, fire detectors and the like all without limitation.

The members of the plurality 30 can be in wired or wireless communication with a fire alarm monitoring control unit indicated generally at 36. The unit 36 is in the vicinity of the region R. A public address system 36-1 can provide verbal condition indicating information throughout region R using a plurality of verbal output transducers. The system 36-1 could be coupled to or part of the monitoring system 36.

One form of a directional sounder is marketed by the System Sensor Division of Honeywell International under the brand name "Exitpoint". Other broadband directional sounders are also available in the market place. When activated members of groups of such devices operate in a non-synchronized fashion to help identify evacuation or output paths.

It will be understood that the region R of FIG. 1 is merely representative and illustrative. A system such as a system 10 can be installed in a single floor of facilities or buildings, as well as multi-floor buildings or facilities, or, underground regions such as mines, all without limitation.

The fire alarm monitoring control unit 36 is of a type which would generally be known to those of skill in the art. It might include one or more programmable processors 36*a* which execute control or monitoring software 36*b*. Additionally, the communications between the members of the plurality 30 and the control unit 36 would also be of a type generally known to those of skill in the art and need not be discussed further. The public address system 30-1 can, in conjunction with the control unit 36, inject live, synthetic, or recorded verbal messages into the region R.

A plurality of directional sounders, indicated generally at 40 is also installed in the region R. It will be understood that the directional sounders, such as sounder 40*i*, might be the same as or comparable to the EXITPOINT directional sounders noted above marketed by System Sensor Division of Honeywell International Inc. The members of plurality 40, for example, member 40*i* can be energized by and operated under the control of the unit 36 in conjunction with the public address system 36-1. Control can be affected wired or wirelessly all without limitation and all such configurations come within the scope of the invention.

As illustrated in FIG. 1, the region R includes a generally L shaped wall W which extends through portions thereof. Some of the members of the plurality 30 are on one side of the wall W and others are on a different side of the wall W. Some members of the plurality of directional sounders 40 are on one side, some are on the other side of the wall W.

The system 10 responds to a circumstance where a fire F has been detected by one or more members of the plurality 30 generally in a vicinity of the exit door E1. As described in more detail subsequently, while the individuals I1 and I2 in the region R are actually physically closer to the Exit E1, safer and more appropriate exit routes for them from the region R are via the exit door E2.

In accordance with the present method and system 10, controllable audio output devices, such as the group 40 of devices including 40-1, -2 . . . -6 can be energized, as discussed in more detail subsequently, to define an audible escape path P1 for the individual I1 toward the exit E2. Alternately, a different path P2 can be audibly presented to the individual 12 by activating the devices 40-10, 12, 14, 16 and device 40-6 to lead the individual 12 audibly toward the exit E2. As explained below, verbal messages could also be selectively broadcast into the region R using system 36-1 and the output devices 40.

Figure 2:
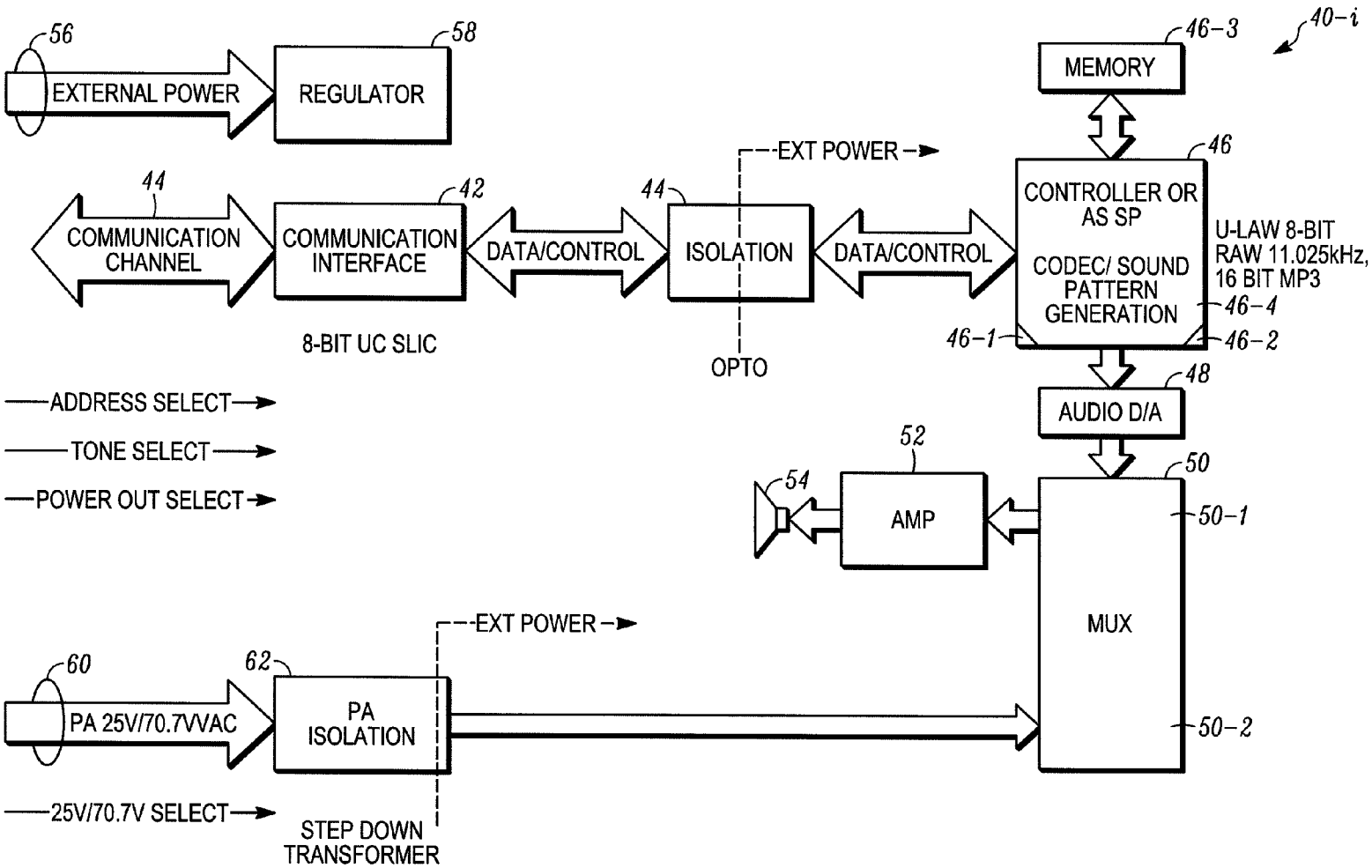
FIG. 2 is a block diagram of an output device in accordance with the invention.

FIG. 2 is a block diagram illustrative of the members of the plurality of devices 40-I. The devices such as 40-*i* include a communications interface 42 which receives data and control information from and which can transmit data to a communication system coupled to unit 36 via a wired or wireless channel 44. Representative communication systems include wire line communications systems which are connected to the control unit 36 for purposes of providing audible evacuation route indicating information. Details of such systems would be known to those of skill in the art and need not be discussed further.

Electrical signals from interface 42 or to interface 42 can be coupled via a bidirectional optical isolation element 44 to and from control circuitry 46. The control circuitry 46 could be implemented with a variety of technologies including one or more programmable processors and local control software indicated at 46-1 and 46-2. A local storage unit 46-3 can be provided for storage of control information and parameters received at the unit 46 via the communications interface 42. Alternately, the control circuits 46 can be implement solely or in part of special purpose circuitry and could include a CODEC-type sound pattern generator 46-4.

The unit 46 then can receive parametric information via communications interface 42 which has been transmitted from a representative control system such as control system or control unit 36. Control parameters which can be transmitted to the unit 40-*i* can include, without limitation, turning the unit on and off, changing an output sound pattern, changing a voice message, providing a locally prestored message, or by passing the unit 40-*i* and coupling voice messages from the public address system 36-1 directly to one or more audio output transducers of the unit 40-*i*.

Digital or output message information can be coupled to a digital-to-analog converter 48. Output audio signals can be coupled to an input port of a multiplexer 50. Audio signals coupled to the input port 50-1, from the digital-to-analog converter 48, can in turn be amplified in amplifier 52 and then coupled to an audio output transducer 54.

Audio output transducer 54 can provide directional audio outputs as discussed above to identify and lead individuals in a region R along a preferred evacuation path. Alternately, the transducer 54 can broadcast verbal messages locally into the region R.

The unit 40-*i* can also be coupled via a signal path 60, which could be a wired connection, to the public address system 36-1. Public address system signals received via the channel 60 can be isolated in a transformer 62 and such audio output signals can then be coupled to a second input port 50-2 of multiplexer 50. The control unit 46 in response to receive parametric information can select a source of output audio for the transducer 54 using the multiplexer 50.

Electrical energy for the unit 40-*i* can be provided by a source of external energy indicated generally at 56 which is locally regulated at a regulator 58.

It will be understood in accordance with the method and system 10 that the exact spacing of the members of the plurality 40 in the region R would be known to those in skill of art and would not represent a limitation of the present invention. The exact number of the members of the plurality 40 would also not represent a limitation of the present invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. An apparatus comprising:

at least one audible output unit which includes:

a communication interface with an input port that can be coupled to a communications system, and an output port coupled to sound generating control circuits, the control circuits receive parametric information which specifies output audio characteristics;

an audio input port, that can be coupled to a regional audio output system;

a multiplexer with on input coupled to the control circuits and with a second input coupled to the audio input port, the multiplexer having an output port; and an audio output transducer coupled to the output port.

2. The apparatus as in claim 1 where the output device comprises a directional sounder.

3. The apparatus as in claim 1 where the control circuits, responsive to received parametric information, selects one of the inputs to the multiplexer.

4. The apparatus as in claim 1 where the parametric information includes at least one of audio activation indicia, sound pattern specifying indicia, voice message specifying indicia, or multiplexer input specifying indicia.

5. The apparatus as in claim 1 which includes a communications system.

6. The apparatus as in claim 5 where the communications system comprises an ambient condition monitoring system.

7. The apparatus as in claim 6 which includes a regional audio output system coupled to the monitoring system.

8. The apparatus as in claim 7 where the regional audio output system is electrically couple to the audio input port.

9. The apparatus as in claim 5 which includes a plurality of audio output units substantially identical to the at least one audio output unit.

10. The apparatus as in claim 9 with the communications system including circuitry to forward output audio specifying parametric information to members of the plurality of output units.

11. The apparatus as in claim 10 where parametric information forwarded to some of the units is different from parametric information forwarded to at least one other unit.

12. The apparatus as in claim 11 where the parametric information includes at least one of audio activation indicia, sound pattern specifying indicia, voice message specifying indicia, or multiplexer input specifying indicia.

13. The apparatus as in claim 12 where the communications system, responsive to a detected condition, related to an evacuation, forwards route specifying parametric information to thereby activate same, to at least some members of the plurality.

14. The apparatus as in claim 13 where the communications system, responsive to changes in the detected condition, forwards different route specifying parametric information to at least some of the units.

15. The apparatus as in claim 14 where the communications system forwards parametric information to at least one unit to couple indicia indicative of a verbal message to the audio output transducer of the at least one unit.

16. The apparatus as in claim 15 where the output transfer comprises at least one of a directional audio output transducer, or a loud speaker.

17. A condition monitoring system comprising:

a control unit with a first communications port to transmit and receive commands and data to and from members of a plurality of ambient condition detectors;

an audio system for transmitting verbal messages into a selected region, the system is coupled to the control unit; and a plurality of audio output devices coupled to the control unit with each of the devices including:

a communication interface with an input port that can be coupled to a communications system, and an output port coupled to sound generating control circuits, the control circuits receive parametric information which specifies output audio characteristics;

an audio input port, that can be coupled to a regional audio output system;

a multiplexer with on input coupled to the control circuits and with a second input coupled to the audio input port, the multiplexer having an output port; and an audio output transducer coupled to the output port.

18. The system as in claim 17 wherein the control unit includes executable software that transmits function specifying parametric information to selected members of the plurality of output devices.

19. The system as in claim 18 where the parametric information is selected from a class which includes at least one of:

audio activation indicia, sound pattern specifying indicia, voice message specifying indicia, or multiplexer input specifying indicia.

20. The system as in claim 19 which includes a plurality of ambient condition detectors and where, responsive to selected, received parametric information, verbal messages from the audio system can be coupled to the output transducer of selected audio output devices.

* * * * *